US006320333B1

(12) United States Patent
Ueda et al.

(10) Patent No.: US 6,320,333 B1
(45) Date of Patent: Nov. 20, 2001

(54) COLOR PICTURE TUBE

(75) Inventors: Yasuyuki Ueda, Osaka; Takashi Ito, Hyogo, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/355,535

(22) PCT Filed: Jan. 28, 1998

(86) PCT No.: PCT/JP98/00376

§ 371 Date: Jul. 29, 1999

§ 102(e) Date: Jul. 29, 1999

(87) PCT Pub. No.: WO98/35374

PCT Pub. Date: Aug. 13, 1998

(30) Foreign Application Priority Data

Feb. 7, 1997 (JP) ..... 9-024932

(51) Int. Cl.[7] ..... G09G 1/04

(52) U.S. Cl. ..... 315/382; 315/14; 315/16; 313/449; 313/414; 313/429

(58) Field of Search ..... 315/382, 382.1, 315/402, 14–16; 313/414, 449, 429, 422, 432, 447

(56) References Cited

U.S. PATENT DOCUMENTS

| | | | |
|---|---|---|---|
| 4,415,831 | 11/1983 | Konosu | 313/413 |
| 4,742,279 | 5/1988 | Gerritsen et al. | 315/382 |
| 4,797,593 | 1/1989 | Saito et al. | 313/346 R |
| 4,814,670 | 3/1989 | Suzuki et al. | 315/15 |
| 4,833,364 | 5/1989 | Izumida et al. | 313/414 |
| 4,876,478 | 10/1989 | Morohashi et al. | 313/413 |
| 4,886,999 | 12/1989 | Yamane et al. | 313/414 |
| 4,945,283 | 7/1990 | Van Der Heijden et al. | 313/450 |
| 4,945,284 | 7/1990 | Shimoma et al. | 313/414 |
| 5,519,290 | 5/1996 | Sugawara et al. | 315/382.1 |
| 5,675,211 | 10/1997 | Ueda | 313/412 |
| 5,754,014 * | 5/1998 | Kim et al. | 315/382.1 |
| 5,760,550 * | 6/1998 | Sukeno et al. | 315/382.1 |
| 5,773,925 | 6/1998 | Kimura et al. | 313/414 |
| 5,818,157 | 10/1998 | Stil et al. | 313/414 |
| 5,831,399 | 11/1998 | Ohta et al. | 315/382.1 |
| 5,905,332 | 5/1999 | Yun et al. | 313/414 |
| 5,942,847 | 8/1999 | Roth | 313/456 |

FOREIGN PATENT DOCUMENTS

| | | |
|---|---|---|
| 0 646 944 | 4/1995 | (EP) . |
| 55-021832 | 2/1980 | (JP) . |
| 55-141051 | 11/1980 | (JP) . |
| 59-111237 | 6/1984 | (JP) . |
| 61-099249 | 5/1986 | (JP) . |
| 01-232643 | 9/1989 | (JP) . |
| 02-106855 | 4/1990 | (JP) . |
| 03-093135 | 4/1991 | (JP) . |

(List continued on next page.)

*Primary Examiner*—Haissa Philogene
(74) *Attorney, Agent, or Firm*—Merchant & Gould P.C.

(57) ABSTRACT

A color picture tube of the present invention comprises three in-line cathodes (1*a,* 1*b,* 1*c*) aligned in the horizontal direction, a first focussing electrode (4) supplied with a focus voltage, a second focussing electrode (5) supplied with a dynamic voltage that changes in accordance with a deflection angle of the electron beams, a final accelerating electrode (7) supplied with an anode voltage, an intermediate auxiliary electrode (6) arranged between the second focussing electrode (5) and the final accelerating electrode (7). The intermediate auxiliary electrode (6) is supplied with a voltage between the voltage of the second focussing electrode (5) and the anode voltage. A non-axisymmetric electrostatic lens for focussing electron beams in the horizontal direction and diverging them in the vertical direction is formed between the first and second focussing electrodes (5, 6). The power of the non-axisymmetric electrostatic lens changes in accordance with a deflection angle of the electron beam.

10 Claims, 12 Drawing Sheets

FOREIGN PATENT DOCUMENTS

| | | | |
|---|---|---|---|
| 03-095835 | | 4/1991 | (JP) . |
| 03-233839 | | 10/1991 | (JP) . |
| 03-283236 | | 12/1991 | (JP) . |
| 07-006707 | | 1/1995 | (JP) . |
| 07-006709 | | 1/1995 | (JP) . |
| 07-147146-A | * | 6/1995 | (JP) . |
| 07-226170 | | 8/1995 | (JP) . |
| 08-022779 | | 1/1996 | (JP) . |

* cited by examiner

COLOR PICTURE TUBE

TECHNICAL FIELD

This invention relates to a color picture tube, and more specifically a color picture tube with an improved electron gun that can provide a high definition image over a whole screen.

BACKGROUND ART

To attain high image resolutions over the entire screen, it is necessary to obtain a small beam spot diameter in a peripheral area as well as a center area of the screen. If a focus voltage is a constant value and adjusted so that the smallest beam spot diameter can be obtained in the center portion, overfocussing may occur in the peripheral portion of the screen, and the beam spot diameter may grow in the peripheral portion.

"Dynamic focussing", which changes the focus voltage in synchronization with the deflection of the electron beam, is a conventional method with which an optimal focus can be attained over the entire screen (see Tokukaisho 61-99249, for example). In this conventional method, first and second focussing electrodes are provided, and a voltage applied to the second focussing electrode is raised along with an increasing deflection angle of the electron beam so that a main lens formed between the second focussing electrode and a final accelerating electrode is weakened. Thus, overfocussing is compensated in the peripheral portion of the screen.

Additionally, in the above mentioned prior art disclosed in Tokukaisho 61-99249, a so-called "four-pole lens" is formed between the first and second focussing electrodes to compensate a non-axisymmetric beam spot distortion in the peripheral portion of the screen. This four-pole lens is formed by providing vertical oblong through holes in the first focussing electrode and horizontal oblong through holes in the second focussing electrode for passing electron beams, for example.

Another prior art disclosed in Japanese laid open patent application (Tokukaihei) 8-22780 is a method for increasing the beam spot diameter along with raising the current density of the electron beam, and compensating a deterioration of image resolution in the peripheral portion of the screen that is caused by a non-axisymmetric distortion of the beam spot due to a spherical aberration of the main lens. In this prior art, a tube-like intermediate auxiliary electrode is provided between the focussing electrode and the final accelerating electrode, and the intermediate auxiliary electrode is supplied with a voltage between the focus voltage and an anode voltage (voltage applied to the final accelerating electrode). Thus, a potential gradient in the axial direction of the main lens becomes gentle, so that the spherical aberration of the main lens can be reduced.

It is a first object of the present invention to raise the resolution over the entire screen by combining two such prior art methods as described above. It is a further object of the present invention to solve the problems occurring when these two prior art method are combined, that is, the shifting of the beam spot, and a difference of focussing ability between horizontal and vertical directions.

DISCLOSURE OF THE INVENTION

A color picture tube of the present invention comprises three inline cathodes, aligned in the horizontal direction, a focussing electrode supplied with a focus voltage, a final accelerating electrode supplied with an anode voltage, and an intermediate auxiliary electrode arranged between said focussing electrode and said final accelerating electrode. A means for separating three electrostatic lenses is provided inside at least one of the focussing electrode and said final accelerating electrode. The intermediate auxiliary electrode has one through hole for passing electron beams, which is shared by three electron beams. The intermediate auxiliary electrode is supplied with a voltage between the focus voltage and the anode voltage. A main lens is formed by said focussing electrode, said intermediate auxiliary electrode and said final accelerating electrode. A non-axisymmetric electrostatic lens for focussing electron beams in the horizontal direction and diverging them in the vertical direction is formed between said main lens and said cathode. A power of said non-axisymmetric electrostatic lens changes in correspondence to a deflection angle of the electron beams.

It is preferable that the focussing electrode includes a first focussing electrode on the cathode side and a second focussing electrode on the screen side, said non-axisymmetric electrostatic lens is formed between said first and second focussing electrodes, said intermediate auxiliary electrode and said first focussing electrode are supplied with voltages obtained by dividing the anode voltage with resistors, and said second focussing electrode is supplied with a dynamic voltage that changes in accordance with a deflection angle of the electron beams.

In an embodiment of the present invention, it is preferable that said focussing electrode includes a first focussing electrode on the cathode side and a second focussing electrode on the screen side, said non-axisymmetric electrostatic lens is formed between said first and second focussing electrodes, said first focussing electrode is supplied with a substantially constant focus voltage, said second focussing electrode is supplied with a dynamic voltage that changes in accordance with a deflection angle of the electron beam, and said intermediate auxiliary electrode is supplied with a voltage generated by dividing the anode voltage with resistors.

As another embodiment of the present invention, it is preferable that said focussing electrode includes a first focussing electrode on the cathode side and a second focussing electrode on the screen side, said non-axisymmetric electrostatic lens is formed between the first and second focussing electrodes, said first focussing electrode is supplied with a substantially constant focus voltage, said second focussing electrode is supplied with a dynamic voltage that changes in accordance with a deflection angle of the electron beam, and said intermediate auxiliary electrode is supplied with a voltage generated by dividing a voltage between said final accelerating electrode and said second focussing electrode with resistors.

With these configurations, the dynamic voltage enhances focus performance in the peripheral portions of the screen, while an electrode configuration with reduced spherical aberration of the main lens, and a more rational voltage supply for the electrodes are attained. Thus, distortions and shifts of the beam spot on the screen are suppressed, so that a high resolution image can be obtained over the whole screen.

It is even more preferable that a second non-axisymmetric electrostatic lens for diverging electron beams in the horizontal direction and focussing them in the vertical direction is formed between said non-axisymmetric electrostatic lens and said cathode. For example, first and second auxiliary electrodes are provided between the cathode and the first focussing electrode, the first auxiliary electrode that is closer to the cathode is connected to the first focussing electrode, the second auxiliary electrode is connected to the second focussing electrode, and the second non-axisymmetric electrostatic lens is formed between the second auxiliary electrode and the first focussing electrode.

It is also preferable that, of three non-axisymmetric electrostatic lenses that are arranged in-line, the two lenses on the sides are shifted from centers of corresponding electron beams in the in-line direction, so as to cancel a beam spot shift on the screen that may be generated when the power of said main lens and the power of said non-axisymmetric electrostatic lens are changed in accordance with a deflection angle of the electron beam.

Moreover, it is preferable, of three non-axisymmetric electrostatic lenses that are arranged in-line, the power of the lens in the center is different from the power of the lenses on the sides, so as to compensate a difference in focus power of the main lens between horizontal and vertical directions that change in accordance with a deflection angle of the electron beam.

The above-mentioned non-axisymmetric electrostatic lens can be formed by providing vertically oblong through holes for passing electron beams in one of two electrodes facing each other and horizontal oblong through holes in another electrode, for example. In this case, the power of the lens in the center can be different from that of lenses on the sides if an aspect ratio of the center oblong beam hole is different from that of side oblong beam through holes in at least one of two electrodes facing each other.

Alternatively, the power of the lens in the center can be different from that of lenses on the sides by providing wall portions around the beam through holes and along the electron beam, and making the height of the wall portions in the center portion different from that in the side portions in at least one of vertical and horizontal oblong beam through holes.

BEST MODE FOR CARRYING OUT THE INVENTION

The following is a description of the preferred embodiments of the present invention, with reference to the accompanying drawings.

Figure 1:
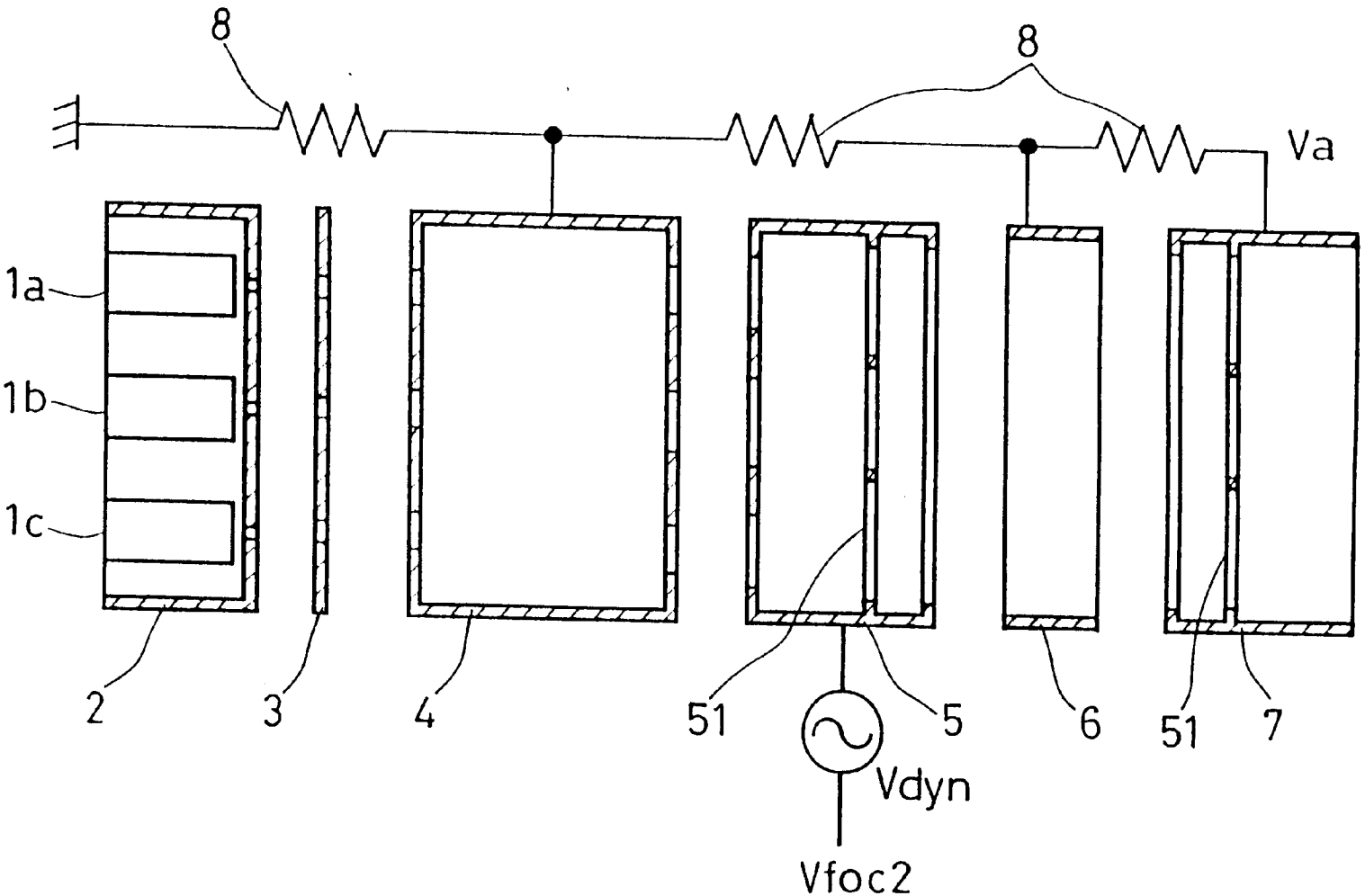
FIG. 1 shows a cross section of an electron gun and a method for supplying voltages to electrodes in a color picture tube according to an embodiment of the present invention.
Figure 2:
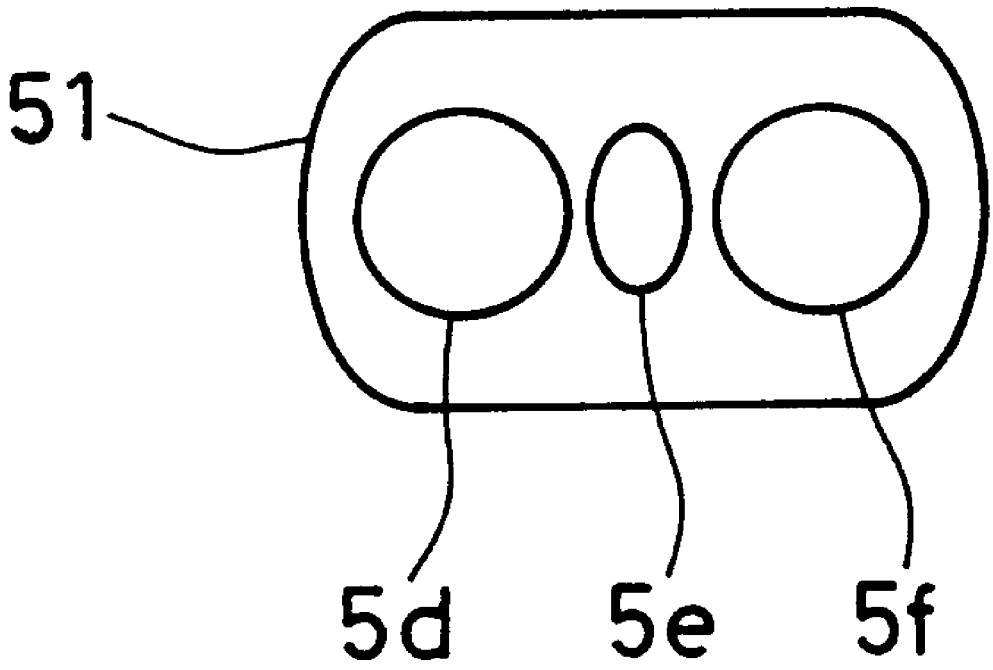
FIG. 2 is a plan view of a planar electrode arranged in a second focussing electrode and a final accelerating electrode of the electron gun shown in FIG. 1.

FIG. 1 illustrates a cross section of an electron gun and a method for supplying voltages to electrodes in a color picture tube according to an embodiment of the present invention. This electron gun includes three inline cathodes 1 (1*a*, 1*b*, 1*c*) aligned in the horizontal direction, a control grid electrode 2, an accelerating electrode 3, a first focussing electrode 4, a second focussing electrode 5, an intermediate auxiliary electrode 6 and a final accelerating electrode 7. As shown in FIG. 2, a planar electrode 51 is arranged in the second focussing electrode 5 and the final accelerating electrode 7. This planar electrode 51 has three through holes 5*d*, 5*e*, 5*f* for passing electron beams. Alternatively, two partition plates can be used for separating three electrostatic lenses corresponding to the three electron beams. This means for separating three electrostatic lenses should be provided in at least one of the second focussing electrode 5 and the final accelerating electrode 7.

As shown in FIG. 1, an anode voltage Va that is applied to the final accelerating electrode 7 is divided by a resistor 8 with two intermediate taps so as to generate two voltages. The lower voltage of those intermediate taps is applied to the first focussing electrode 4 and the higher voltage of those intermediate taps is applied to the intermediate auxiliary electrode 6. The second focussing electrode 5 is supplied with a focus voltage Vfoc2 onto which is superimposed a dynamic voltage Vdyn that changes in accordance with a deflection angle of the electron beam.

Figure 3:
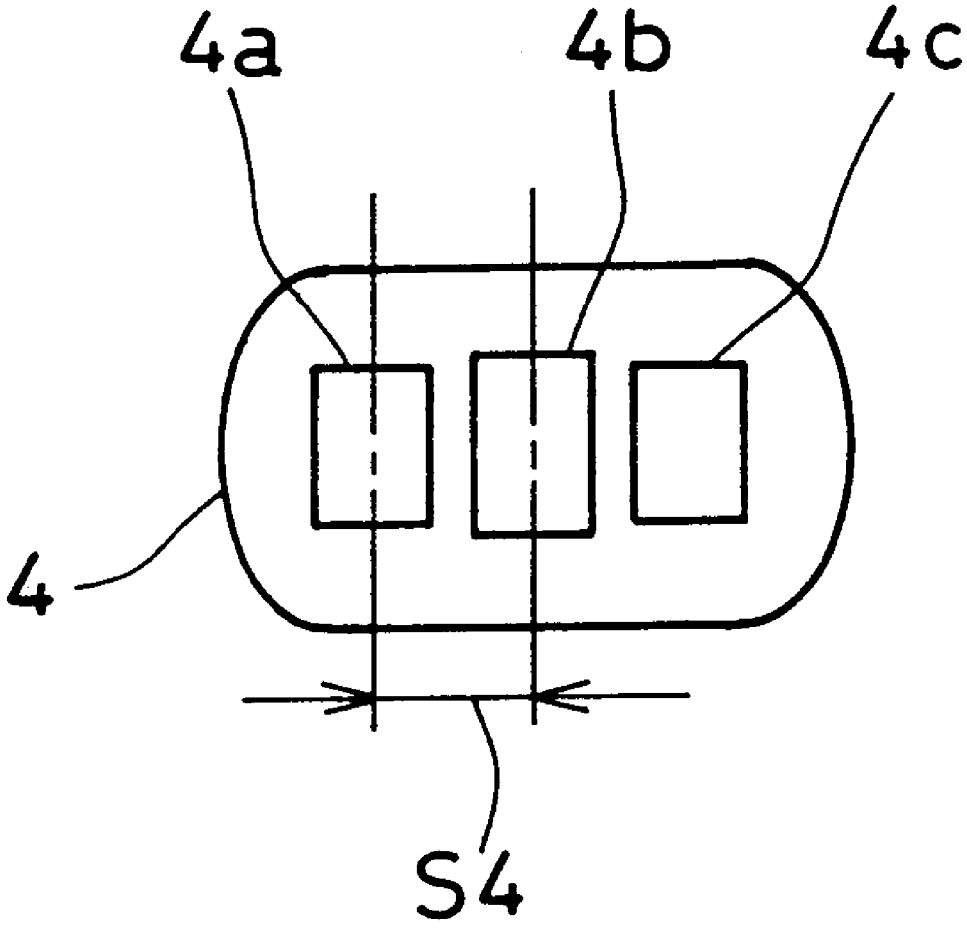
FIG. 3 is a plan view of a first focussing electrode of the electron gun shown in FIG. 1.
Figure 4:
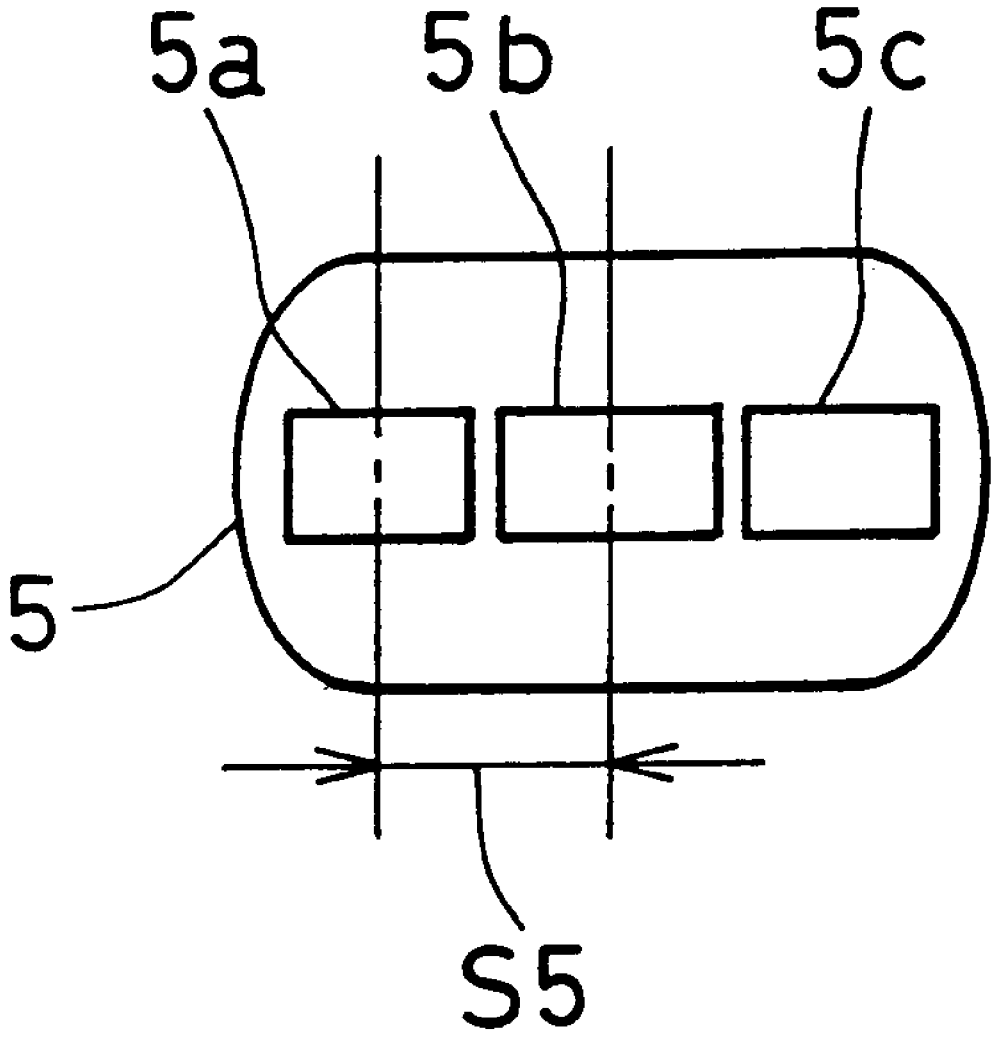
FIG. 4 is a plan view of a second focussing electrode of the electron gun shown in FIG. 1.

The first focussing electrode 4 has three vertically oblong through holes 4*a*, 4*b*, 4*c* for passing electron beams in the plane facing the second focussing electrode 5 as shown in FIG. 3. On the other hand, the second focussing electrode 5 has three horizontally oblong through holes 5*a*, 5*b*, 5*c* in the plane facing the first focussing electrode 4 as shown in FIG. 4. These three pairs of the vertically oblong and horizontally oblong through holes form three in-line non-axisymmetric electrostatic lens members (so-called four-pole lenses) to define a non-axisymmetric electrostatic lens, which focuses electron beams in the horizontal direction and diverges them in the vertical direction. Thus, the non-axisymmetric electrostatic lens compensates a flat oblong distortion of a beam spot on the screen.

If, as shown in FIG. 3, the pitch (distance between centers of through holes) of the electron beam passing through holes 4*a*, 4*b*, 4*c* in the first focussing electrode 4 is S4, and, as shown in FIG. 4, the pitch (distance between centers of through holes) of the through holes 5*a*, 5*b*, 5*c* in the second focussing electrode 5 is S5, then the centers of the non-axisymmetric electrostatic lenses formed between the first and second focussing electrodes 4, 5 can be shifted with respect to the center of the electron beams in the horizontal direction by adjusting the pitches S4 and S5. Thus, a shift of the electron beams due to variations of the main lens power is compensated, so that a shift of the beam spot on the screen can be suppressed.

Additionally, as shown in FIG. 3, an aspect ratio of the vertically oblong through hole 4*b* in the center of the first focussing electrode 4 is larger than that of the through holes 4*a*, 4*c* of both sides. Similarly, as shown in FIG. 4, an aspect ratio of the horizontally oblong through hole 5*b* in the center of the second focussing electrode 5 is larger than that of the through holes 5*a*, 5*c* of both sides. This configuration compensates a difference of the focussing power of the main lens between the horizontal and vertical directions. It is not always necessary that both of the first and second focussing electrode 4, 5 have the above-mentioned configuration, and it is sufficient if at least one of them has the above mentioned configuration.

Figure 5A:
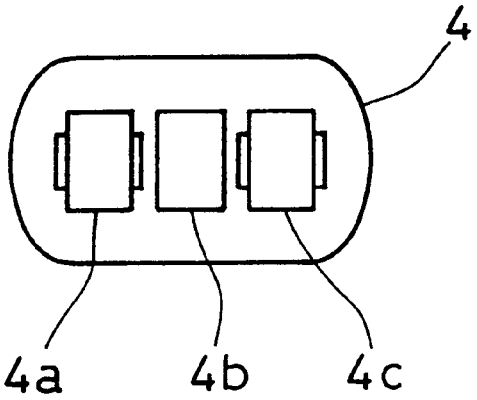
FIG. 5A is a plan view showing another configuration of the first focussing electrode of the electron gun shown in FIG. 1.
Figure 5B:
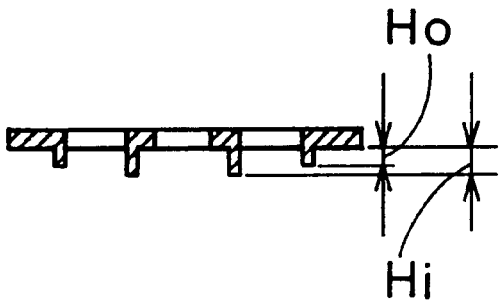
FIG. 5B is a cross section of the first focussing electrode shown in FIG. 5A.
Figure 6A:
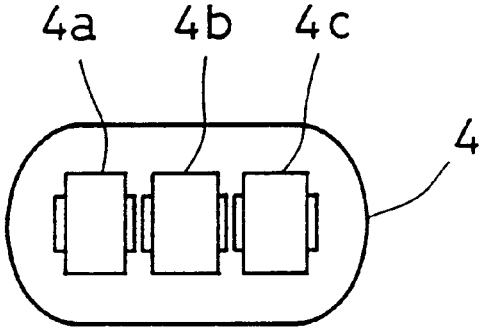
FIG. 6A is a plan view showing another configuration of the first focussing electrode of the electron gun shown in FIG. 1.
Figure 6B:
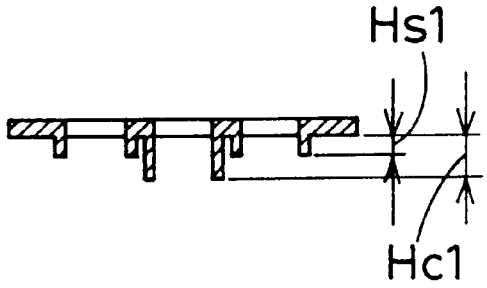
FIG. 6B is a cross section of the first focussing electrode shown in FIG. 6A.

It is also possible that the first focussing electrode 4 is configured as shown in FIG. 5A and 5B to compensate the focussing power difference of the main lens between the horizontal and vertical directions. In this case, the aspect ratio of the oblong through holes 4*a*, 4*b*, 4*c* is the same for all of these through holes. However, wall portions are provided on left and right sides of the vertically oblong through holes 4*a*, 4*c* on both sides, and the height Hi of the inner wall is higher than the height Ho of the outer wall. Alternatively, as shown in FIG. 6A and 6B, wall portions may be provided on left and right sides of all vertically oblong through holes 4*a*, 4*b*, 4*c*, and height Hcl of the wall portions of the center through hole may be higher than height Hsl of the wall portions of the side through holes 5*a*, 5*c*.

Figure 7A:
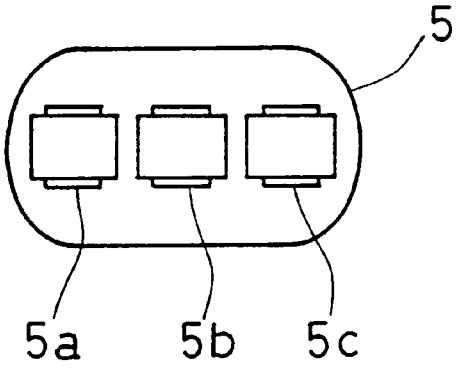
FIG. 7A is a plan view showing another configuration of the second focussing electrode of the electron gun shown in FIG. 1.
Figure 7B:
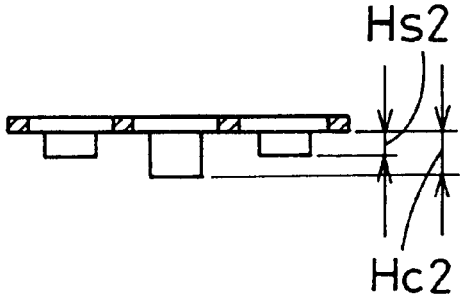
FIG. 7B is a cross section of the second focussing electrode shown in FIG. 7A.

Alternatively, as shown in FIG. 7A and 7B, wall portions may be provided on upper and lower sides of the horizontally oblong through holes 5*a*, 5*b*, 5*c* of the second focussing electrode 5, and the height Hc2 of the wall portions of the center through hole 5*b* may be higher than the height Hs2 of the wall portions of the side through holes 5*a*, 5*c* to attain the same effect.

Figure 8:
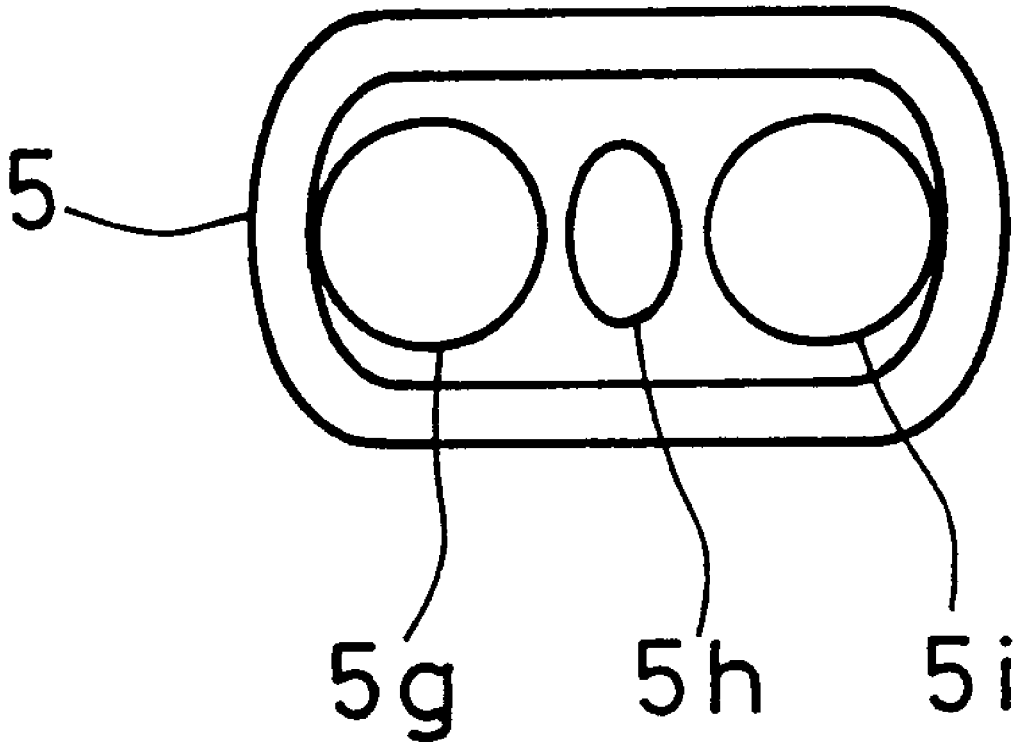
FIG. 8 is a plan view of a planar electrode arranged in the second focussing electrode of the electron gun shown in FIG. 1.
Figure 9:
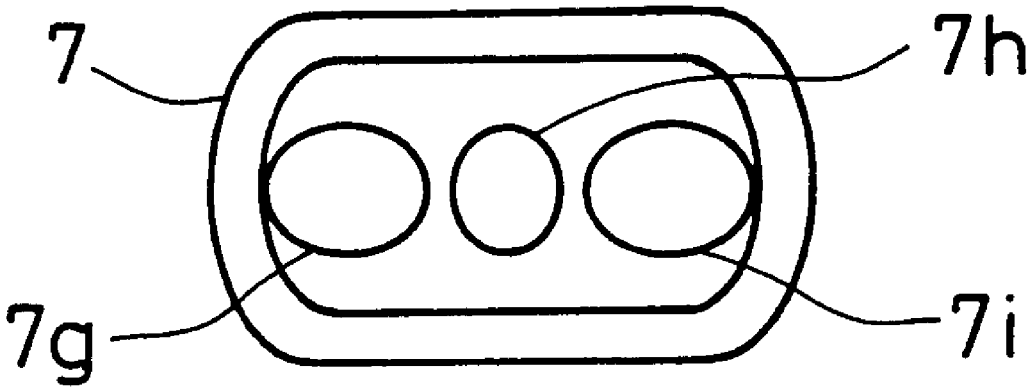
FIG. 9 is a plan view of a planar electrode arranged in the final accelerating electrode of the electron gun shown in FIG. 1.

In another method for compensating the focus power difference of the main lens between the horizontal and vertical directions, as shown in FIG. 8 and 9, three through holes 5*g*, 5*h*, 5*i* (7*g*, 7*h*, 7*i*) for passing an electron beam formed in the planar electrode arranged in the second focussing electrode 5 and the final accelerating electrode 7 may be changed in shape between center and side holes. Additionally, the through holes 5*g*, 5*h*, 5*i* in the second focussing electrode 5 are more oblong in the vertical direction than the through holes 7*g*, 7*h*, 7*i* in the final accelerating electrode 7.

Figure 10:
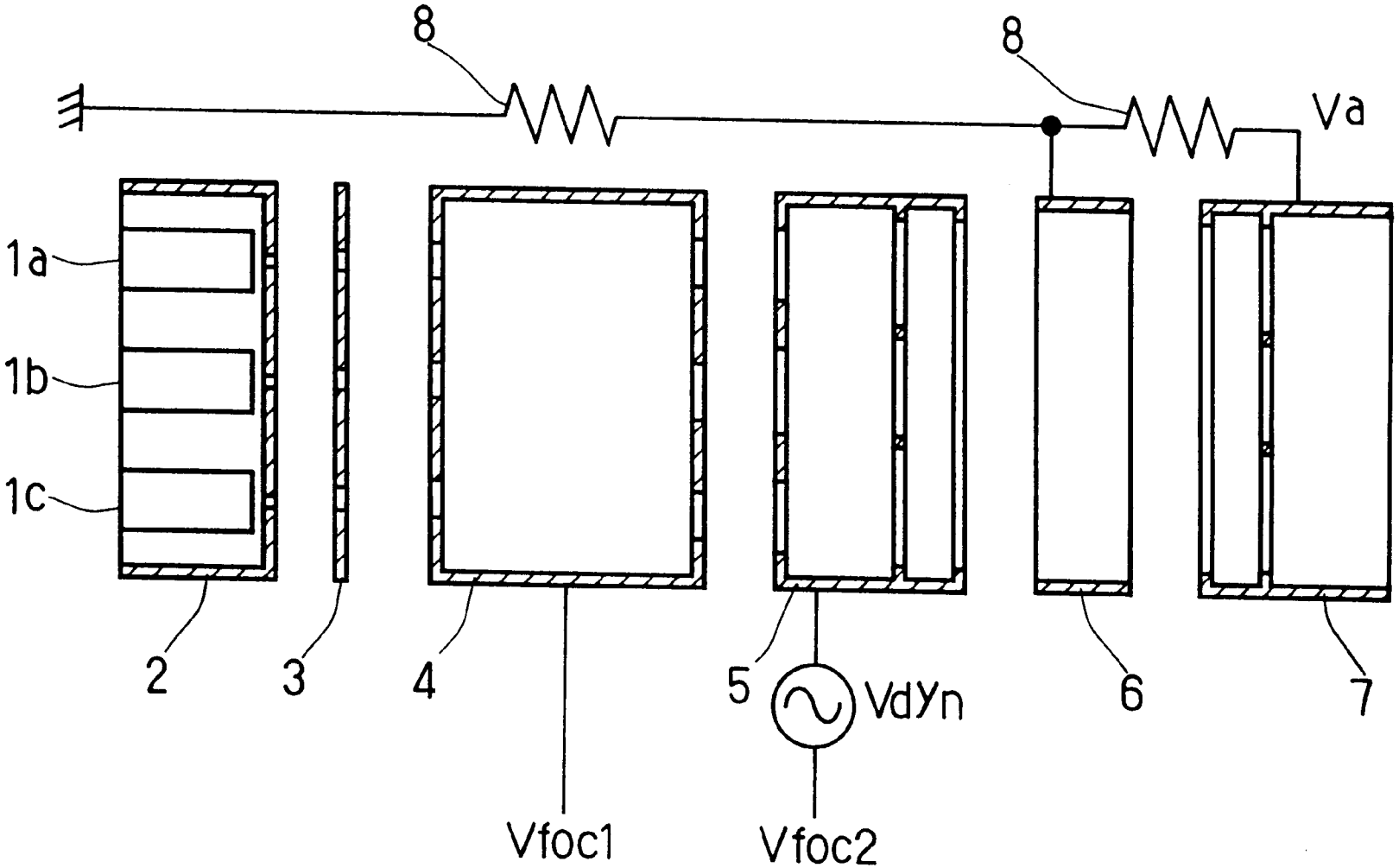
FIG. 10 shows a cross section of an electron gun and a method for supplying voltages to electrodes in a color picture tube according to another embodiment of the present invention.

Another embodiment for applying the proper voltage to each electrode is shown in FIG. 10. In this embodiment, the first focussing electrode 4 is supplied not with a voltage divided by the resistor 8 but with a substantially constant focus voltage Vfoc1 supplied from outside. Voltages applied to other electrodes are the same as the embodiment shown in FIG. 1. In this case too, the same effect can be obtained by arranging the electron beam through holes of the electrodes in the manner explained above.

Figure 11:
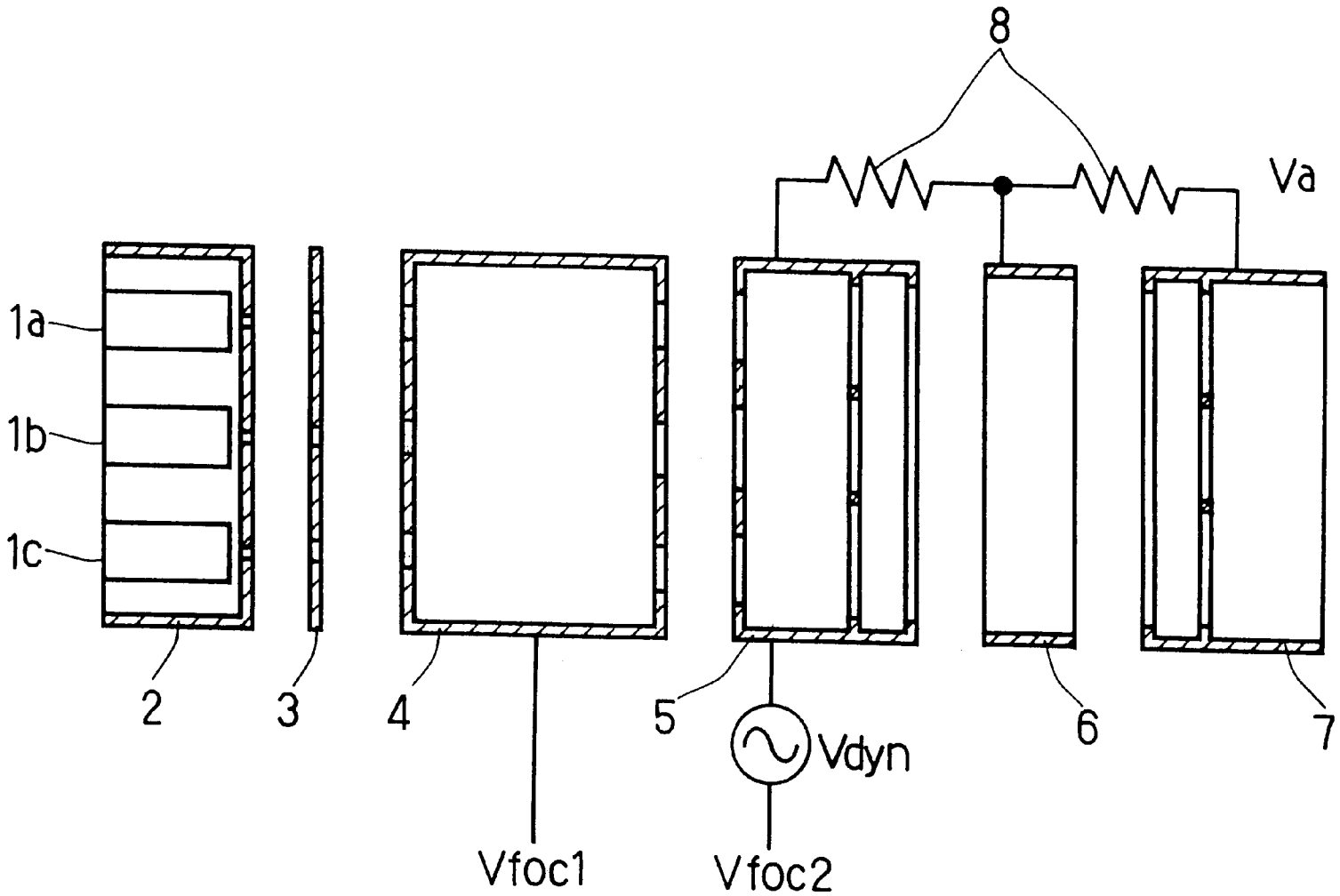
FIG. 11 shows a cross section of an electron gun and a method for supplying voltages to electrodes in a color picture tube according to yet another embodiment of the present invention.

FIG. 11 shows another embodiment for applying the proper voltage to each electrode. In this embodiment, the first focussing electrode 4 is supplied with a substantially constant focus voltage Vfoc1, the second focussing electrode 5 is supplied with a second focus voltage Vfoc2 superimposed with a dynamic voltage Vdyn that changes in accordance with a deflection angle of the electron beam, and the intermediate auxiliary electrode 6 is supplied with a voltage generated by dividing a voltage difference between the final accelerating electrode 7 (anode voltage Va) and the second focussing electrode 5 with the resistor 8.

According to this configuration, when the second focussing electrode is supplied with the voltage that is changed in accordance with the deflection angle, the potential of the intermediate auxiliary electrode 6 also changes, so that a variation of the voltage difference between the second focussing electrode 5 and the intermediate auxiliary electrode 6 is reduced. As a result, each lens portion constituting the main lens is weakened overall, and the variation of lens power is reduced. Thus, the shift of the beam spot on the screen and the difference of the focus power between the horizontal and vertical direction can be reduced.

Figure 12:
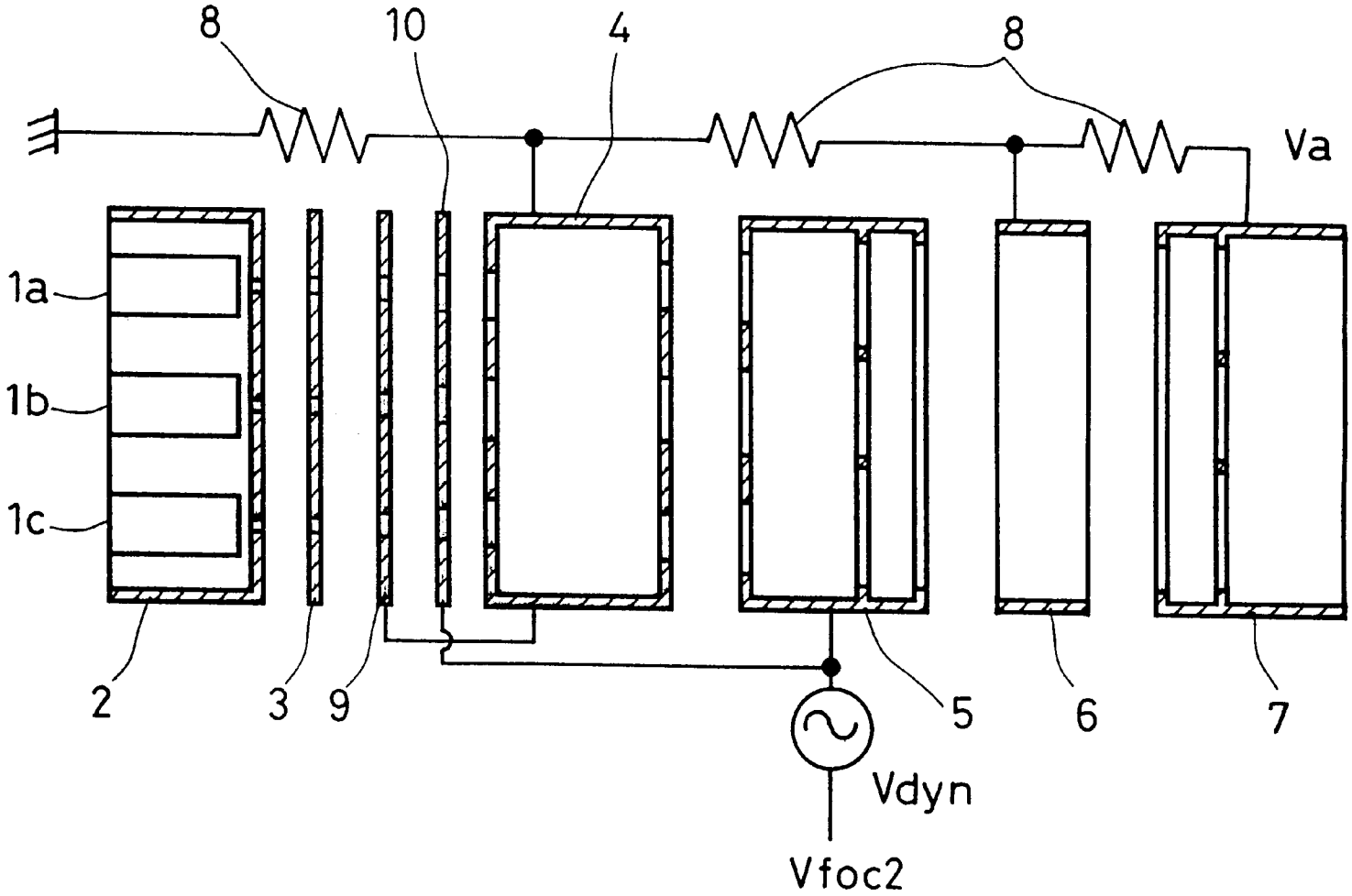
FIG. 12 shows a cross section of an electron gun and a method for supplying voltages to electrodes in a color picture tube according to yet another embodiment of the present invention.

FIG. 12 shows another embodiment, in which first and second auxiliary electrodes 9, 10 are added between the accelerating electrode 3 and the first focussing electrode 4. The first auxiliary electrode 9 that is on the side of the accelerating electrode 3 (side of the cathode 2) is connected to the first focussing electrode 4, and the second auxiliary electrode 10 is connected to the second focussing electrode 5. The second auxiliary electrode 10 and the first focussing electrode 4 form a non-axisymmetric electrostatic lens that diverges an electron bean in the horizontal direction and focuses it in the vertical direction. This non-axisymmetric electrostatic lens varies its power in correspondence to the deflection angle.

According to this configuration, the shift of the beam spot on the screen and the difference of the focus power between the horizontal and vertical direction can be reduced by the non-axisymmetric electrostatic lens formed between the first focussing electrode 4 and the second focussing electrode 5 as well as by the non-axisymmetric electrostatic lens formed between the second auxiliary electrode 10 and the first focussing electrode 4. In this case, the centers of the three electron beams can be aligned with the centers of the three main lenses. In this configuration too, the above mentioned methods for applying voltages to the electrodes can be utilized.

What is claimed is:

1. A color picture tube, comprising: three inline cathodes, aligned in the horizontal direction; a focussing electrode supplied with a focus voltage; a final accelerating electrode supplied with an anode voltage; and an intermediate auxiliary electrode arranged between said focussing electrode and said final accelerating electrode; wherein said focussing electrode is composed of a first focussing electrode on the cathode side and a second focussing electrode on the screen side, said second focussing electrode being supplied with a dynamic voltage that changes in accordance with a deflection angle of the electron beams; a non-axisymmetric electrostatic lens is formed between said first and second focussing electrode, said non-axisymmetric electrostatic lens focussing electron beams in the horizontal direction and diverging them in the vertical direction;

means for separating three electrostatic lenses is provided inside at least one of said focussing electrode and said final accelerating electrode; said intermediate auxiliary electrode has one through hole for passing electron beams, which is shared by three electron beams, said intermediate auxiliary electrode being supplied with a voltage between the focus voltage and the anode voltage; and a main lens is formed by said focussing electrode, said intermediate auxiliary electrode and said final accelerating electrode;

whereby said non-axisymmetric electrostatic lens formed between said main lens and said cathodes compensates a non-axisymmetric electrostatic lens effect of diverging in the horizontal direction and focussing in the vertical direction which is caused in said main lens due to the supply of said dynamic voltage.

2. The color picture tube according to claim 1, wherein said intermediate auxiliary electrode and said first focussing electrode are supplied with respective voltages obtained by dividing the anode voltage with resistors.

3. The color picture tube according to claim 1, wherein said first focussing electrode is supplied with a substantially constant focus voltage.

4. The color picture tube according to claim 1, said focussing electrode includes a first focussing electrode on the cathode side and a second focussing electrode on the screen side, said non-axisymmetric electrostatic lens is formed between the first and second focussing electrodes, said first focussing electrode is supplied with a substantially constant focus voltage, said second focussing electrode is supplied with a dynamic voltage that changes in accordance with a deflection angle of the electron beam, and said intermediate auxiliary electrode is supplied with a voltage generated by dividing a voltage between said final accelerating electrode and said second focussing electrode with resistors.

5. The color picture tube according to claim 1, wherein a second non-axisymmetric electrostatic lens for diverging electron beams in the horizontal direction and focussing them in the vertical direction is formed between said non-axisymmetric electrostatic lens and said cathode.

6. The color picture tube according to claim 5, wherein first and second auxiliary electrodes are provided between said cathode and said first focussing electrode, said first auxiliary electrode, which is closer to said cathode, is connected to said first focussing electrode, said second auxiliary electrode is connected to said second focussing electrode, and said second non-axisymmetric electrostatic lens is formed between said second auxiliary electrode and said first focussing electrode.

7. The color picture tube according to claim 1, wherein, of three non-axisymmetric electrostatic lenses that are arranged in-line, the two lenses on the sides are shifted from centers of corresponding electron beams in the in-line direction, so as to cancel a beam spot shift on the screen that may be generated when the power of said main lens and the power of said non-axisymmetric electrostatic lens are changed in accordance with a deflection angle of the electron beam.

8. The color picture tube according to claim 1, wherein, of three non-axisymmetric electrostatic lenses that are arranged in-line, the power of the lens in the center is different from the power of the lenses on the sides, so as to compensate a difference in focus power of the main lens between horizontal and vertical directions that change in accordance with a deflection angle of the electron beam.

9. The color picture tube according to claim 8, wherein the non-axisymmetric electrostatic lens is formed by vertically oblong through holes for passing electron beams provided in one of two electrodes facing each other and horizontal oblong through holes provided in the other electrode, and an aspect ratio of the center oblong beam through hole is different from that of side oblong beam holes in at least one of the two electrodes facing each other so that a power of lens in the center is different from that of the lenses on the sides.

10. The color picture tube according to claim 8, wherein the non-axisymmetric electrostatic lens is formed by vertically oblong through holes for passing electron beams provided in one of two electrodes facing each other and horizontally oblong through holes provided in another electrode, wall portions are formed along the direction of the electronic beams at a peripheral portion of at least one of the vertically oblong through holes and the horizontally oblong through holes, and a height of the wall portions in the center portion is different from that in the side portions so that a power of the lens in the center is different from that of lenses on the sides.

* * * * *